United States Patent [19]

Galimov et al.

[11] 4,243,108

[45] Jan. 6, 1981

[54] PNEUMATIC INPACT WRENCH HAVING ROTATABLE AND AXIALLY TRANSLATABLE COMPONENTS

[76] Inventors: Anas G. Galimov, ulitsa Kuibysheva, 15, kv. 13, Sverdlovsk; Mikhail L. Gelfand, Yaroslavskoe shosse, 129, kv. 44; Boris G. Goldshtein, ulitsa Molodogvardeiskaya, 24, korpus 1, kv. 26, both of Moscow; Viktor E. Kilin, ulitsa Posadskaya, 44, korpus 2, kv. 40; Oleg Y. Sutyagin, ulitsa Dekabristov, 5, kv. 51, both of Sverdlovsk; Yakov I. Tsipenjuk, ulitsa Kirova, 5, kv. 30, Solntsevo Moskovskoi oblasti; Georgy A. Antipov, ulitsa Krasny Mayak, 3, kv. 146, Moscow; Oleg A. Yankovsky, ulitsa Soni Morozovoi, 175a, kv. 95, Sverdlovsk, all of U.S.S.R.

[21] Appl. No.: 957,370

[22] Filed: Nov. 3, 1978

[30] Foreign Application Priority Data

Nov. 21, 1977 [SU] U.S.S.R. ..... 2545320

[51] Int. Cl.[3] ..... B25D 15/00

[52] U.S. Cl. ..... 173/93

[58] Field of Search ..... 173/93, 93.5, 93.6, 173/94, 96, 97, 104, 109, 111, 112, 113, 93.7; 81/52.3, 52.35

[56] References Cited

U.S. PATENT DOCUMENTS

| | | | |
|---|---|---|---|
| 3,174,559 | 3/1965 | Vaughn | 173/93.5 X |
| 3,610,344 | 10/1969 | Schoeps | 173/93.5 |
| 3,804,180 | 4/1974 | Gelfand et al. | 173/15 |
| 3,908,768 | 9/1975 | Hess | 81/52.3 |
| 3,952,814 | 4/1976 | Gelfand et al. | 173/93 |

*Primary Examiner*—Werner H. Schroeder

[57] ABSTRACT

An impact wrench comprises an anvil having impact jaws, a composite hammer including a driving part coupled to an output shaft of a pneumatic motor and a driven part having impact jaws for co-operating with the impact jaws of the anvil and mounted in the driving part for a combined rotation and a relative axial movement. A diametrical slot is provided in the driving part to receive a slider having its center of gravity offset relative to the hammer axis. The anvil receives a stub shaft mounted for a combined rotation together therewith and a relative axial movement and having a spring-loaded locking member co-operating with the slider. This construction of the pneumatic impact wrench enables a greater amount of kinetic energy to be transmitted into a threaded joint with each blow so as to improve the efficiency and reduce vibrations.

2 Claims, 12 Drawing Figures

PNEUMATIC INPACT WRENCH HAVING ROTATABLE AND AXIALLY TRANSLATABLE COMPONENTS

FIELD OF THE INVENTION

This invention relates to impact wrenches, and more particularly to pneumatic impact wrenches to be used in various industries for torque tightening of vital threaded joints.

BACKGROUND OF THE INVENTION

Known in the art are impact wrenches comprising a composite hammer including a driving part and a driven part between which there are disposed flyweights (cf. U.S. Pat. No. 3,804,180). Such impact wrenches exhibit high stability of blow energy and an adequate reliability. They may be used for tightening bolts made of medium-hard steel, as well as high tensile bolts.

When these impact wrenches are used for tightening superhigh tensile bolts, where high tightening torque is required, failures of heavily loaded components, in particular impact jaws occur. This is due to the fact that complete mating of impact jaws (in the axial direction) of the hammer and anvil occurs at a certain angle of engagement which is equal to the angular space between the respective jaws. To make the jaws stronger, their thickness is to be increased to result in a smaller angle of engagement. Moreover, the practice of operation of such impact wrenches shows that, with high tightening torques, the hammer and anvil should preferably be made with three jaws rather than two to make them stronger, which is impossible in the above-described impact wrenches.

Known in the art is an impact wrench (cf. U.S. Pat. No. 3,952,814) having a casing accommodating an axially immobile anvil having impact jaws, a composite hammer having impact jaws, and also a device for preliminary interaction of the hammer and anvil before engagement of their impact jaws, which enables the complete making of the impact jaws of the hammer and anvil in the axial direction during operation of the impact wrench in an automatic impacting cycle.

In the above-described impact wrenches, the driven part of the hammer is caused to move by flyweights (balls or rods) which requires a certain radial dimension to obtain a desired axial displacement of the driven part of the hammer so that such impact wrenches are only suitable for tightening large-diameter threaded fasteners.

Also known in the art is a pneumatic impact wrench comprising a casing accommodating a pneumatic motor having an output shaft, an anvil rigidly connected to a spindle, a composite hammer including a driving part coupled to the output shaft and a driven part received therein and connected thereto for a combined rotation and a relative axial movement. A guide roller is received in the driving part of the hammer, a return spring disposed between the driven part of the hammer and the anvil, and a stub shaft received in the anvil and connected thereto for a combined rotation and a relative axial movement. The stub shaft has a cam surface for co-operating with the guide roller (cf. Manual "Mekhanizirovanny Instrument, Otdelochnye Mashiny i Vibratory" (in Russian). TsNIITE Minstroydormash, 1975, pp. 179–180). Impact wrenches of this type featuring a positive displacement of the hammer into engagement with the anvil may be used for tightening threaded joints with high torque values. A substantially smaller angle of engagement is required in such impact wrenches to ensure complete mating of impact jaws of the hammer and anvil so that they may be provided with three jaws, respectively. Moreover, such impact wrenches feature a small radial dimension.

The impact wrenches of this type are, however, deficient in inadequate efficiency as each blow is delivered upon one revolution of the hammer. This does not permit a sufficient amount of energy to be accumulated and requires a high number of blows (about 120) to be delivered to tighten a threaded joint, which substantially reduces the efficiency of the process. Moreover, in view of the high blow rate, such impact wrenches exhibit an increased level of vibrations.

SUMMARY OF THE INVENTION

It is an object of the invention to improve the efficiency and to lower vibrations of pneumatic impact wrenches.

In accordance with this and other objects, the present invention provides an improved pneumatic wrench. The wrench includes a casing and a pneumatic motor enclosed within the casing. An impact clutch is partially enclosed by the casing and has an anvil connected to a spindle for a combined rotation. The anvil includes impact jaws. A composite hammer is provided that has a driving part coupled to an output shaft of the pneumatic motor and a driven part received in the driving part. The driven part is connected to the driving part of the hammer for a combined rotation and a relative axial movement and has impact jaws for engaging the impact jaws of the anvil. A guide roller is disposed in the driving part of the hammer, while a return spring is disposed between the driven part of the hammer and the anvil. A stub shaft is received in the anvil and connected thereto for a combined rotation and a relative axial movement. The shaft has a cam surface for co-operating with the guide roller. The guide roller is mounted on a silder received in a diametrical slot of the driving part of the hammer. The center of gravity of the slider is offset relative to the hammer axis, and the slider has a groove facing the anvil and a crater on the opposite side to receive a spring-loaded ball mounted in the output shaft. The stub shaft has a spring-loaded locking member mounted for a combined rotation with the stub shaft and for an axial movement relative thereto and a chamfered end received in the groove of the slider and oriented with respect to the cam surface of the stub shaft. A mechanism is provided for returning the slider back into an initial position, the mechanism being operatively connected to the slider and to the driving part of the hammer.

The mechanism for returning the slider back into the initial position preferably comprises a plate having holes and carrier rollers received therein and in radially extending holes of the driving part of the hammer. One of the radially extending holes of the driving part of the hammer is open-ended, the slider has a hole at the end thereof opposite to the guide roller. The carrier roller is received in the open-ended hole of the driving part of the hammer and has a carrier pin received in the hole of the slider.

Therefore, owing to the arrangement of the guide roller on the slider, there is provided a possibility of accumulating a sufficient amount of energy in the rotating masses (each blow is delivered at a pre-set rotary speed of the hammer) so that the number of blows required to tighten a threaded joint is lowered. This results in a substantial improvement of the efficiency of the process. At the same time, it is possible to considerably strengthen the impact jaws of the hammer and anvil as these components are positively brought into engagement. Moreover, owing to the lower blow rate, vibrations are reduced.

BRIEF DESCRIPTION OF THE DRAWINGS

The invention will now be described in greater detail with reference to specific embodiments thereof taken in conjunction with the accompanying drawings, in which.

DETAILED DESCRIPTION OF THE INVENTION

Figure 1:
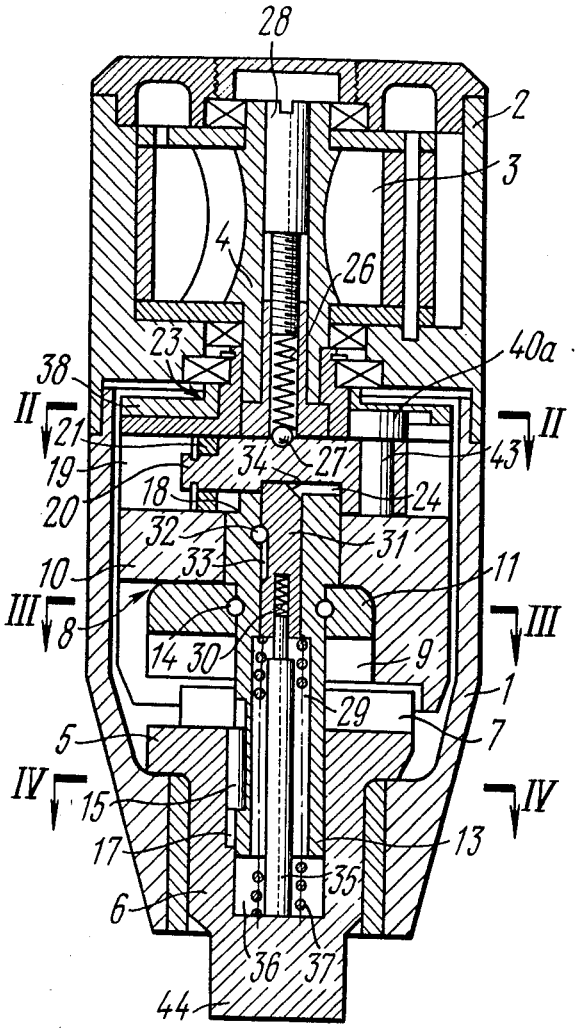
FIG. 1 is a longitudinal section of a pneumatic impact wrench.
Figure 2:
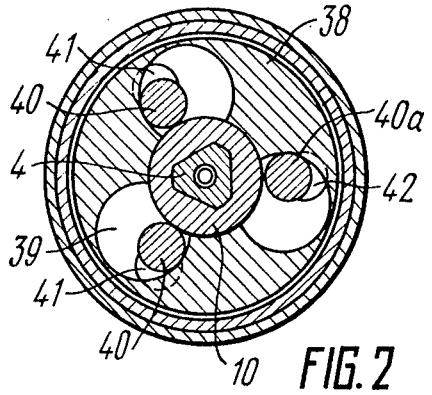
FIG. 2 is a sectional view taken along the line II—II of FIG. 1.

A pneumatic impact wrench comprises a casing made of two parts 1 and 2 (FIG. 1), one part 1 accommodating an impact clutch and the other part 2 accommodating a pneumatic motor 3 having an output shaft 4 provided with a trihedral end portion as shown in FIG. 2.

The impact clutch (FIG. 1) comprises an anvil 5 which is connected for a combined rotation with a spindle 6 (or is integral therewith) and has impact jaws 7, and a composite hammer 8 having impact jaws 9 for engaging the impact jaws 7 of the anvil 5, the anvil 5 being axially immobile and rotatable togetherwith the hammer.

Figure 3:
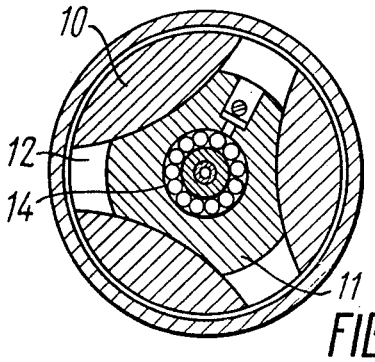
FIG. 3 is a sectional view taken along the line III—III of FIG. 1.

The composite hammer 8 includes a driving part 10 which is directly coupled to the output shaft 4 of the pneumatic motor, and a driven part 11 having impact jaws 9 and received in the driving part 10, the driving part 10 of the hammer having grooves 12 (FIG. 3) to receive the driven part 11 which is connected to the driving part 10 for a combined rotation and a relative axial movement.

Figure 4:
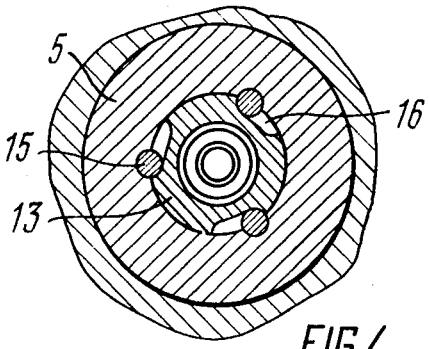
FIG. 4 is a sectional view taken along the line IV—IV of FIG. 1.

A stub shaft 13 is received in axial bores of the driving part 10 of the hammer and anvil 5. The driven part 11 of the hammer is connected to the stub shaft 13 by means of a ball bearing 14 and is axially movable relative to the driving part 10 together with the stub shaft 13, the stub shaft 13 being connected to the anvil 5 for a combined rotation and for an axial movement relative thereto which is ensured by rollers 15 (FIG. 4) received in grooves 16 and 17 of the stub shaft 13 and anvil 5, (FIG. 1), respectively.

Figure 5:
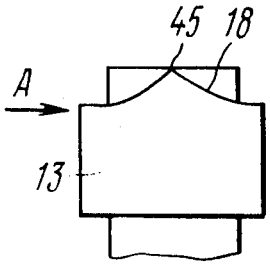
FIG. 5 shows a fragmentary view of a stub shaft of the impact clutch of the wrench shown in FIG. 1.
Figure 6:
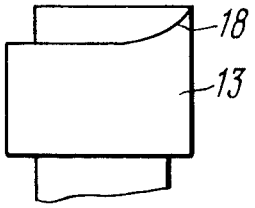
FIG. 6 is a view taken along the arrow A of FIG. 5.

A symmetrical cam surface 18 (FIGS. 5 and 6) oriented with respect to the impact jaws 7 (FIG. 1) of the anvil 5 is provided at the end of the stub shaft 13, facing the shaft 4.

Figure 7:
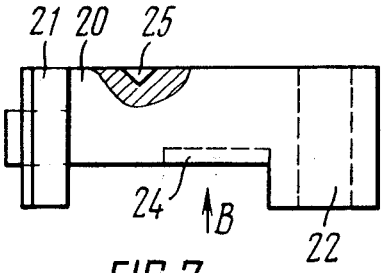
FIG. 7 shows a slider of the impact clutch, partially in section.
Figure 8:
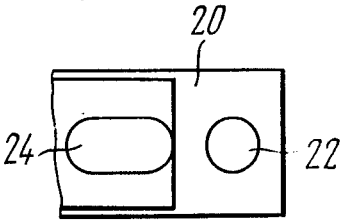
FIG. 8 is a fragmentary view taken along the arrow B of FIG. 7.

A diametrical slot 19 is made in the driving part 10 of the hammer to receive a slider 20 having at one end a guide roller 21 which is oriented with respect to the impact jaws 9 and co-operates with the cam surface 18 of the stub shaft 13, and the other end of the slider has an open-ended hole 22 (FIGS. 7 and 8). The center of gravity of the slider 20 is offset relative to the hammer axis so that the slider can move in the diametrical slot 19 of the driving part 10 of the hammer during its rotation. The impact wrench has a mechanism 23 (FIG. 9) which is operatively connected to the slider and to the driving part 10 of the hammer and is designed to return the slider back into the initial position.

The slider 20 has a groove 24 facing the anvil 5, and a crater 25 is made in the slider on the opposite side thereof (i.e. on the side facing the output shaft 4) to receive a ball 27 (FIG. 1) loaded by a spring 26 and received in the output shaft 4. The force of the spring 26 is adjustable by means of a screw 28.

The stub shaft 13 has an axial passage 29 receiving a locking member 31 loaded by a spring 30, which is coaxial with the anvil 5, rotatable together with the stub shaft 13 and axially movable relative thereto, which is ensured by means of a pin 32 and a flat 33. The locking member 31 has a chamfered end 34 which is received in the groove 24 of the slider 20 and is oriented with respect to the cam surface 18 of the stub shaft 13.

One end of the spring 30 abuts against the locking member 31 and the other end bears against the end face of a pin 35 mounted in an axial bore 36 of the anvil 5. The impact clutch has a return spring 37 disposed between the driven part 11 of the hammer and the anvil 5.

The mechanism 23 for returning the slider 20 back into the initial position comprises a plate 38 (FIGS. 1, 2 and 10) having holes 39 and loosely mounted on the driving part 10 of the hammer, and carrier rollers 40 and **40*a*. The holes 39 of the plate 38 partially receive the carrier rollers 40 and 40*a*. The driving part 10 of the hammer has two blind radially extending holes 41 and one open-ended radially extending hole 42 which is located opposite to the hole 22 of the slider 20. The carrier rollers 40 are partially received in the radially extending holes 41 of the driving part 10 of the hammer, and the carrier roller 40*a* is partially received in the radially extending hole 42, the carrier roller 40*a* (FIGS. 1 and 8) which is received in the open-ended radially extending hole 42 having a pin 43 which is received in the hole 22 of the slider 20**.

An end 44 of the spindle 6 extending outside the casing of the impact wrench has means for fitting a socket wrench thereon.

Operation

Figure 11:
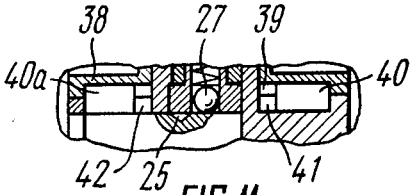
FIG. 11 is a sectional view taken along the line XI—XI of FIG. 10.
Figure 12:
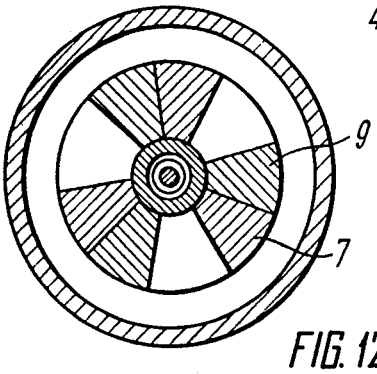
FIG. 12 is a sectional view taken along the line XII—XII of FIG. 9.

A socket wrench (not shown in FIGS. 1 and 9) is fitted on the end 44 of the spindle 6 extending outside the casing and is applied to a threaded fastener. After the air powered or pneumatic motor 3 is put on, the hammer 8 is accelerated, the rotary motion from the output shaft 4 being transmitted to the driving part 10 and driven part 11 of the hammer. The slider 20 and the plate 38 driven by the carrier rollers 40 and **40*a* rotate together with the driven part 11 and the driving part 10 of the hammer. As the hammer 8 gains higher speed, the centrifugal force applied to the slider 20 in the direction towards the roller 40***a* having the pin 43 grows greater. When this force (at a pre-set rotary speed of the hammer) exceeds the resistance offered by the spring-loaded ball 27 received in the crater 25 of the slider 20, the ball 27 (FIG. 11) will be forced out of the crater 25, whereafter the slider 20 can move in the slot 19 of the driving part 10 of the hammer. This movement takes place after the chamfered end 34 of the locking member 31 turns into the position shown in FIG. 9. In this position the locking member 31 starts being forced out of the groove 24 of the slider 20, and the latter will move in the slot 19 of the hammer. As the chamfered end 34 of the locking member 31 is oriented with respect to the cam surface 18 of the stub shaft 13, the movement of the slider 20 and guide roller 21 is started at the moment at which the guide roller 21 is behind a vertex 45 (FIG. 5) of the cam surface 18 so as to ensure complete engagement of the guide roller 21 with the horizontal portion of the cam surface 18. When the guide roller 21 engages the cam surface 18, the stub shaft 13 moves together with the driven part 11 of the hammer towards the anvil 5 for engagement of their impact jaws 7 (FIG. 12) and 9, and a blow is delivered at which the kinetic energy accumulated in the rotating masses is transmitted into the threaded joint.

Figure 10:
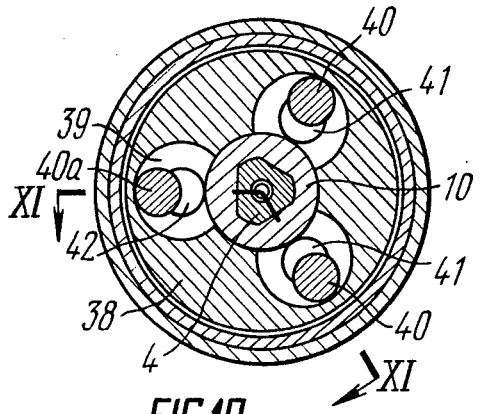
FIG. 10 is a sectional view taken along the line X—X of FIG. 9.
Figure 9:
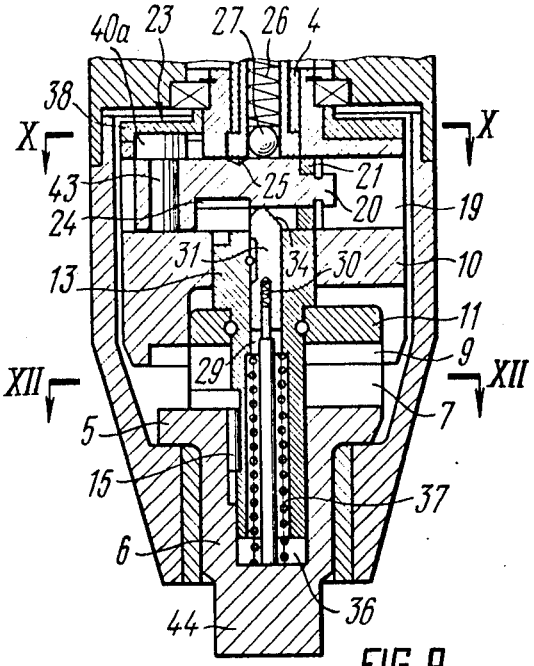
FIG. 9 shows the position of components of the impact clutch at the moment of blow.

The position of the components of the impact clutch at the moment of blow is shown in FIG. 9. The position of the carrier rollers 40 and 40*a* at the moment of blow is shown in FIG. 10.

As the guide roller 21 (FIG. 1) is oriented relative to the impact jaws 9, and the cam surface 18 is oriented relative to the impact jaws 7, complete mating of the impact jaws 9 and 7 occurs in the axial direction without any edge-to-edge contact.

Upon the blow, the hammer 8 is completely decelerated, and the plate 38 continues to rotate by inertia. Owing to this rotation, the walls of the holes 39 (FIG. 2) act on the carrier rollers 40 and 40*a* to cause their displacement in the radially extending holes 41 and 42 towards the center. The roller 40*a* moves together with the slider 20 to return it back into the initial position.

After the slider 20 (FIG. 1) returns back into the initial position, and the ball 27 is received in the crater 25, the spring 37 returns the stub shaft 13 with the driven part 11 of the hammer back into the initial position, and the impact jaws 9 and 7 are disengaged. The locking member 31 is returned back into the initial position under the action of the spring 30. The blows are then repeated until the motor is put off.

Rotary speed of the hammer, hence energy of blow is adjusted by adjusting the effective force of the spring 26 by means of the screw 28.

What is claimed is:

1. A pneumatic impact wrench comprising: a casing; a pneumatic motor having an output shaft, accommodated in said casing; an anvil journalled in said casing, connected to a spindle for a combined rotation and having impact jaws; a composite hammer accommodated in said casing and including a driving part and a driven part; said driving part of the hammer being coupled to the output shaft of said pneumatic motor; said driven part of the hammer being disposed in the driving part and connected thereto for a combined rotation and a relative axial movement and having impact jaws for engaging the impact jaws of the anvil; a diametrical slot in the driving part of said composite hammer; means for causing rotation and axial movement of the driven part of said composite hammer; a slider disposed in said diametrical slot and having its center of gravity offset relative to the axis of said composite hammer, said slider being movable from a first, initial position to a second position by rotation of said driving part; a guide roller mounted on said slider; a groove in said slider, facing said anvil; a crater in said groove; a spring-loaded ball received in said crater and mounted in the output shaft of said pneumatic motor for holding said slider in the initial position; a return spring disposed between the driven part of said composite hammer and said anvil; a stub shaft disposed in said anvil and connected thereto for a combined rotation and a relative axial movement; means for rotating and axially moving said stub shaft; a cam surface of said stub shaft for co-operating with said guide roller upon movement of said slider from its initial position; a spring-loaded locking member disposed in said stub shaft and mounted for a combined rotation together therewith and for an axial movement relative thereto; means for rotating and axially moving said spring-loaded locking member; a chamfered end of said spring-loaded locking member, received in said groove of the slider and oriented with respect to said cam surface of said stub shaft; a mechanism for returning said slider back into the initial position, which is operatively connected to the slider and to the driving part of said composite hammer.

2. A pneumatic impact wrench according to claim 1, wherein the mechanism for returning the slider back into the initial position comprises a plate having holes and carrier rollers received in the holes of the plate, the driving part of the hammer having radially extending holes of which one hole is an open-ended hole, said carrier rollers being received in said holes; said slider has a hole at the end thereof opposite to the guide roller; one of said carrier rollers disposed in the open-ended radially extending hole of the driving part of the hammer has a pin received in the slider hole.

* * * * *